US012024803B2

(12) United States Patent
Andreoli et al.

(10) Patent No.: US 12,024,803 B2
(45) Date of Patent: Jul. 2, 2024

(54) CIRCULAR KNITTING MACHINE WITH SYSTEM FOR OFFSETTING THE PLATE OF THE NEEDLES WITH RESPECT TO THE CYLINDER OF THE NEEDLES

(71) Applicant: SANTONI S.P.A., Brescia (IT)

(72) Inventors: Marco Andreoli, Castegnato (IT); Andrea Lonati, Brescia (IT); Sergio Gatta, Montirone (IT)

(73) Assignee: SANTONI S.P.A., Brescia (IT)

( * ) Notice: Subject to any disclaimer, the term of this patent is extended or adjusted under 35 U.S.C. 154(b) by 196 days.

(21) Appl. No.: 17/620,834

(22) PCT Filed: Jun. 16, 2020

(86) PCT No.: PCT/IB2020/055614
§ 371 (c)(1),
(2) Date: Dec. 20, 2021

(87) PCT Pub. No.: WO2020/254959
PCT Pub. Date: Dec. 24, 2020

(65) Prior Publication Data

US 2022/0333282 A1 Oct. 20, 2022

(30) Foreign Application Priority Data

Jun. 19, 2019 (IT) ..... 102019000009495

(51) Int. Cl.
*D04B 15/94* (2006.01)
*D04B 15/16* (2006.01)

(52) U.S. Cl.
CPC ..... *D04B 15/94* (2013.01); *D04B 15/16* (2013.01)

(58) Field of Classification Search
CPC ..... D04B 9/46; D04B 15/94; D04B 15/16; D04B 15/18

(Continued)

(56) References Cited

U.S. PATENT DOCUMENTS 3,181,312 A * 5/1965 Felker ..... D04B 15/94 66/28
3,440,837 A * 4/1969 Lester ..... D04B 15/94 66/19

(Continued)

FOREIGN PATENT DOCUMENTS

JP S6221848 A 1/1987

OTHER PUBLICATIONS

Search Report dated Sep. 18, 2020 in corresponding International Application No. PCT/IB2020/055614, 4 pages.

(Continued)

*Primary Examiner* — Danny Worrell
(74) *Attorney, Agent, or Firm* — MH2 TECHNOLOGY LAW GROUP LLP

(57) ABSTRACT

A circular knitting machine for knitted or hosiery items includes a supporting structure; a needle-holding cylinder rotatable around an axis of rotation and supporting a plurality of cylinder needles that are movable for producing a knitted fabric; a dial assembly, arranged above the cylinder and comprising a needle-holding plate rotating around the axis of rotation and supporting a plurality of plate needles that are movable for producing a knitted fabric. The machine includes motion generation elements, in order to rotate the needle-holding cylinder around the axis of rotation, and motion transmission elements configured for forming a motion transmission chain capable of transmitting to the plate, synchronously with respect to the cylinder, the rotation generated by the motion generation elements. The motion transmission elements include a first toothed wheel, receiving the rotary motion of the motion generation elements; a second toothed wheel, mounted coaxially with the needle-holding plate; an offset device, located between the first and the second toothed wheel and comprising an inlet gear, engaged with the first toothed wheel, and an outlet gear, engaged with the second toothed wheel. The inlet and outlet gears are mounted coaxially with one another and are translatable by an actuator, so as to change the engagement of the inlet gear with the first toothed wheel and/or the (Continued)

engagement of the outlet gear with the second toothed wheel.

20 Claims, 2 Drawing Sheets

(58) Field of Classification Search
USPC ..... 66/28
See application file for complete search history.

(56) References Cited

U.S. PATENT DOCUMENTS 3,491,556 A * 1/1970 Lester ..... D04B 15/18 66/19
3,969,911 A * 7/1976 Lonati ..... D04B 15/94 66/14
4,030,318 A * 6/1977 Philip ..... D04B 9/06 66/147
4,068,496 A * 1/1978 Bourgeois ..... D04B 15/94 66/27
5,275,020 A * 1/1994 Scherzinger ..... D04B 35/30 66/8

OTHER PUBLICATIONS

Written Opinion dated Sep. 18, 2020 in corresponding International Application No. PCT/IB2020/055614, 10 pages.

* cited by examiner

FIG.1
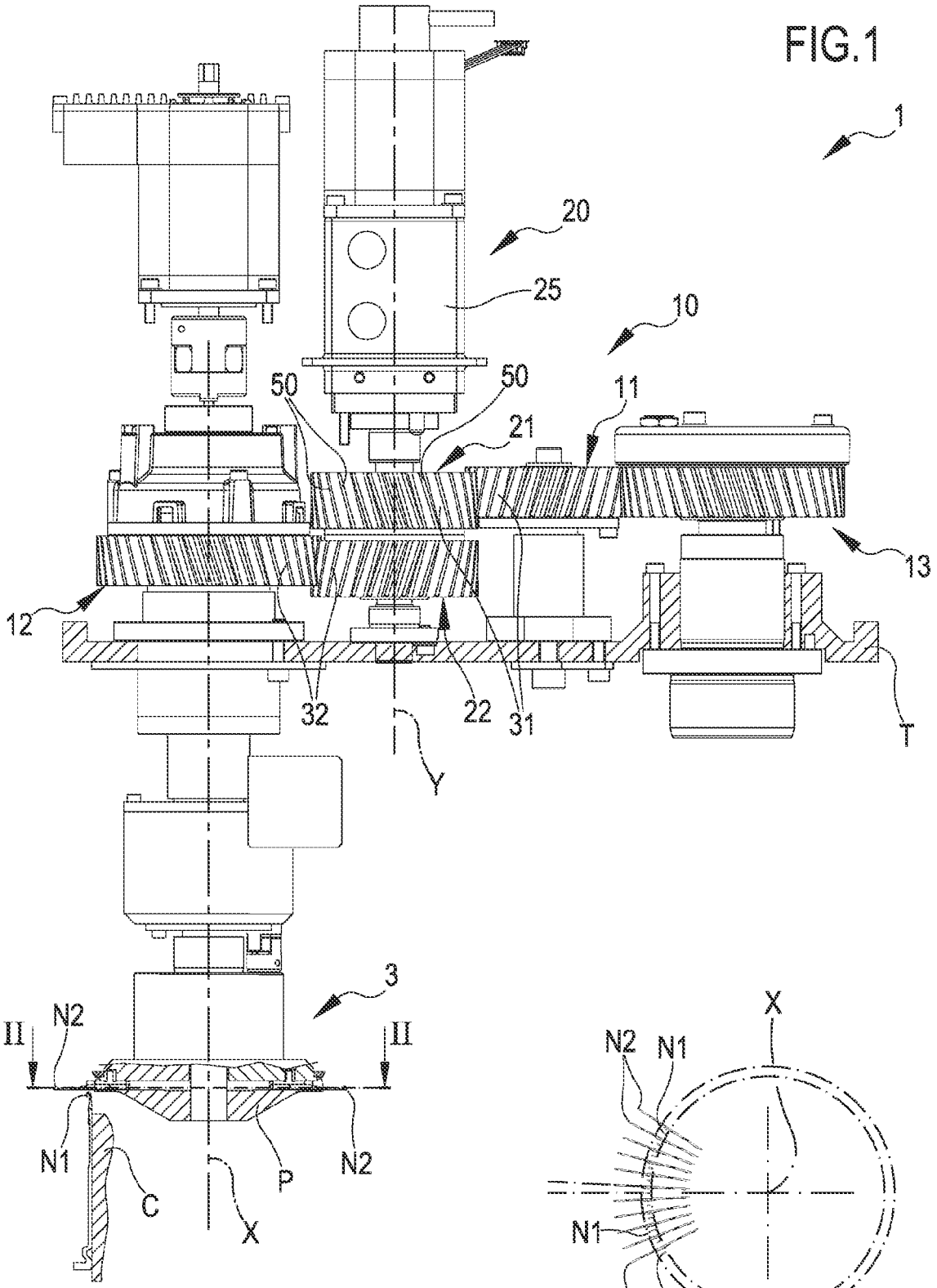
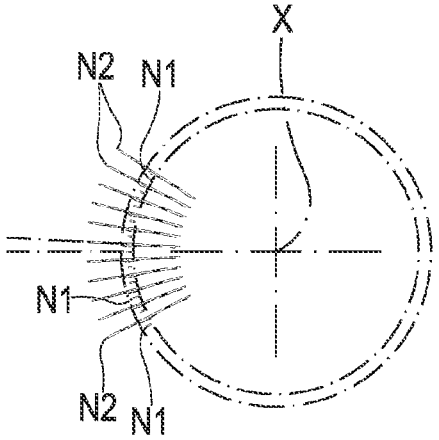
FIG.2

FIG.3
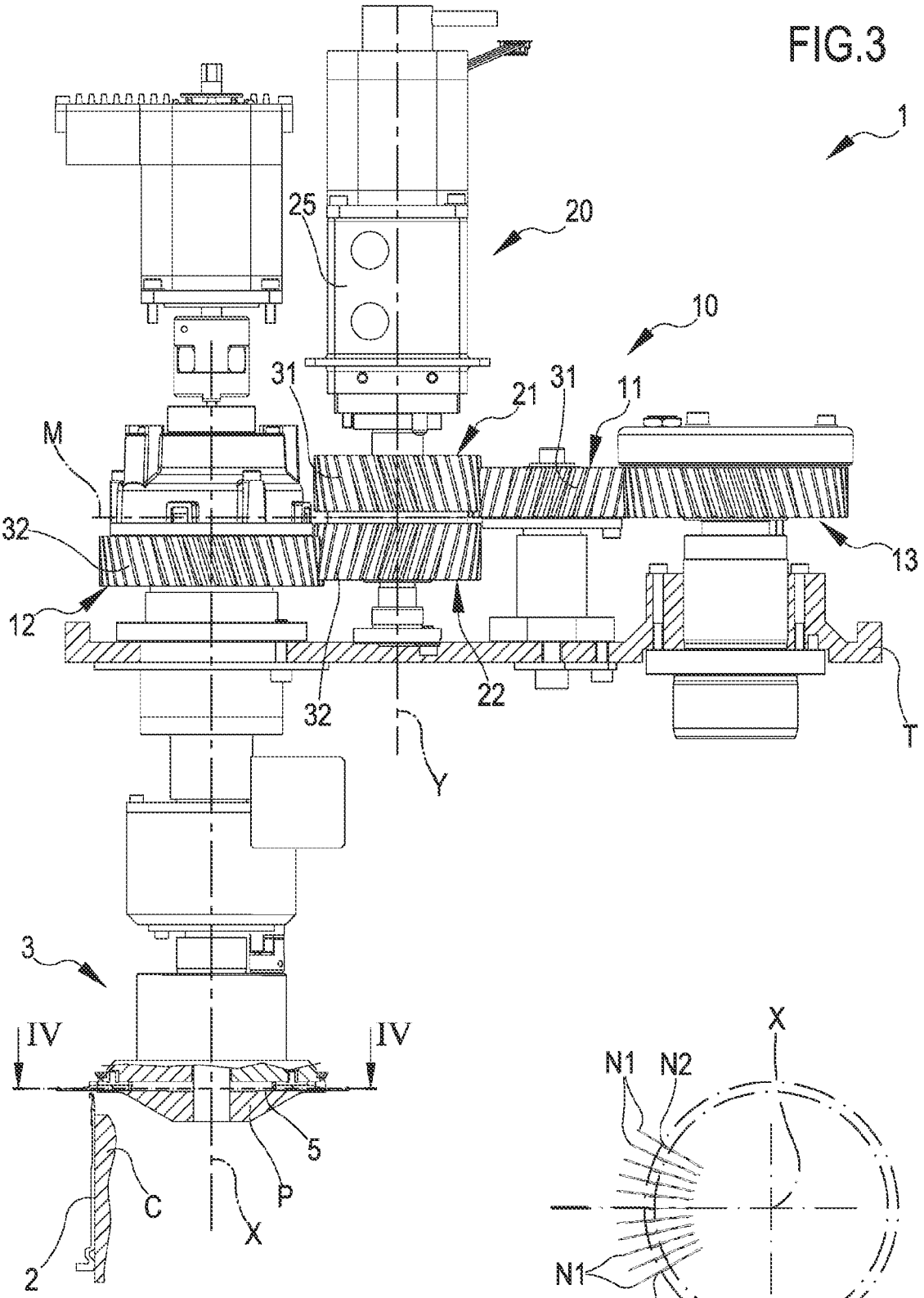
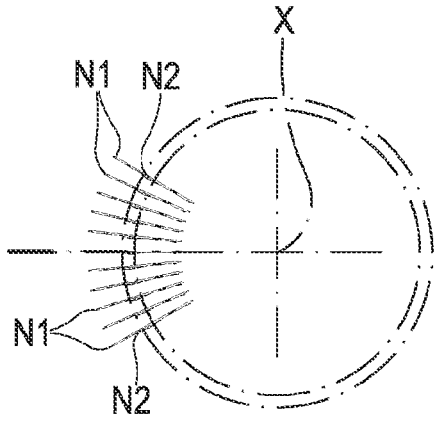
FIG.4

CIRCULAR KNITTING MACHINE WITH SYSTEM FOR OFFSETTING THE PLATE OF THE NEEDLES WITH RESPECT TO THE CYLINDER OF THE NEEDLES

CROSS-REFERENCE TO RELATED APPLICATIONS

This application is a U.S. National Stage application of PCT/IB2020/055614 filed Jun. 16, 2020, pending, which claims priority to Italian Application No. 102019000009495 filed Jun. 19, 2019, the entire disclosures of which are hereby incorporated by reference.

The object of the present invention is a circular knitting machine. In particular, the invention regards a circular knitting machine for hosiery or knitted items provided with a system which allows offsetting the plate of the needles with respect to the cylinder of the needles.

The present invention is situated in the technical field of circular knitting machines for hosiery items, for knitted items, knitted items of "seamless" type, and the like.

In the present text, with the term "knitting machine" it is intended in general a circular knitting machine adapted to produce textile articles and provided with at least one needle-holding element or needle-holding cylinder turnably mounted in a supporting structure of the machine and supporting, in suitable sliding seats (or needle seats), a plurality of movable needles parallel to an axis of rotation of the needle-holding cylinder in order to produce a knitted fabric.

In addition, the knitting machine is provided with one or more of thread feed points, or thread "feeds", in which the yarn is supplied to the needles of the machine. The circular knitting machines can comprise a variable number of feeds, e.g. 1, 2, 4, 6, 8 or more thread feeds.

The knitting machine can for example be of double-needle bed type.

Specifically, the present invention is in particular—but not exclusively—intended for circular knitting machines which comprise, in addition to the aforesaid cylinder of the needles, also a plate of the needles, i.e. an element that is also turnably mounted on the supporting structure of the machine and supporting, in respective suitable sliding seats (or needle seats), a plurality of respective needles (termed plate needles).

The plate of the needles is placed above the cylinder of the needles and coaxially thereto: this signifies that the cylinder and the plate both rotate around the same axis of rotation. The plate needles are movable, in the respective seats, on a plane orthogonal to the aforesaid axis of rotation, and along directions that are radial with respect to the axis of rotation, with a translational motion approaching and moving away from the axis of rotation. The plate needles cooperate with the cylinder needles in the formation of the knitwear. Typically, cylinder and plate are positioned in a manner such that the heads of the cylinder needles, vertically movable, intersect with the heads of the plate needles, horizontally movable, during the rotation of the cylinder and of the plate, on the basis of the movements imparted by the driving means (cams, selection elements, etc.) of the needles. Such machine type is known, in the jargon of the field of knitting machines for hosiery items, as a "mono-cylinder with needles in the plate" circular knitting machine, i.e. a knitting machine provided with a needle-holding cylinder and with a plate provided with additional needles thereof, which cooperate with the cylinder needles in the formation of the knitwear, allowing the obtainment of particular textile structures. The plate needles therefore support the cylinder needles and such machine is comparable to a double-needle bed machine (having needles both on the cylinder and on the plate).

In this type of knitting machine, there are typically a lower number of plate needles than cylinder needles. For example, there can be a number of plate needles equal to half the cylinder needles, with one plate needle located between two adjacent needles of the cylinder.

In the present text with the expression "dial assembly", it is intended the portion of the knitting machine arranged above the needle-holding cylinder and carrying the aforesaid plate of the needles. Such assembly is provided with elements and devices adapted to cooperate with the plate needles and with the threads present in the feeds in order to allow the production of knitwear.

In the field of circular knitting machines, different modes are known for attaining the dial assembly and the devices connected thereto. In general, the dial assembly is typically provided with a fixed supporting ring, with a thread transport and cutting element (indicated in the field with the term "thread-trimmer knife") mounted outside the supporting ring so to be able to rotate around it, and with a plurality of pneumatic devices positioned on the supporting ring.

Such plurality of pneumatic devices usually comprises at least one assembly for driving the needles, provided with one or more driving cams capable of interacting with the plate needles, and a plurality of gripper assemblies, for example equal in number to the feeds of the machine; each gripper assembly comprises one or more movable grippers, capable of retaining or blocking a thread supplied to the needles of the knitting machine, and pneumatic actuators which move such grippers.

The dial assembly can also comprise cutting devices, or "thread trimmer knives", each provided with a cutting element capable of cooperating with the aforesaid knife in order to execute the cutting of the threads transported by the knife itself. In addition, the dial assembly can comprise thread suction devices, or "thread suction pipes", which suction the threads of one or more feeds and the relative fluff.

In substance, the dial assembly comprises at its interior a grouping of numerous devices, some modularly repeated for each feed, others shared among multiple feeds or present individually.

The dial assembly also comprises the aforesaid plate of the needles, carrying its respective plurality of needles. Such plate is mounted on the supporting ring in a manner such to be able to rotate around an axis of rotation coinciding with the axis of rotation of the needle-holding cylinder. The aforesaid knife is also integral with the plate, and rotates together therewith.

The aforesaid driving cams interact with the plate needles in order to impart thereto, during the rotation of the plate, a radial movement within the respective seat, approaching and moving away from the axis of rotation, based on a specific law of motion defined by the profile of the cams. In such a manner, the plate needles are moved as desired so that they interact in the desired manner with the cylinder needles, for the formation of the knitwear.

Overall, the driving cams define a "circular" cam profile, i.e. extended as a ring around the axis of rotation, with which the driving heels of the plate needles sequentially interact.

The known knitting machines also comprise means for transmitting the rotation, which carry out the function of transmitting to the needle-holding plate, rotating in the dial assembly, the rotation generated by the needle-holding cylinder. Indeed, if the needle-holding plate was independently actuated with respect to the needle-holding cylinder, its rotary motion might result asynchronous or variable (in an unpredictable manner) with respect to the rotary motion of the needle-holding cylinder, while it is necessary—in order to attain knitwear in the correct manner—that plate and cylinder be moved during working with a synchronous rotation. Hence, the aforesaid transmission means typically comprise pairs of pulleys, transmission belts and auxiliary shafts that form a rigid kinematic chain and transmit to the needle-holding plate—synchronously with respect to the cylinder—the rotation generated by the motor which moves the needle-holding cylinder. In substance, the same motor which actuates the needle-holding cylinder provides a same rotation, through suitable transmission means, also to the needle-holding plate: it follows that an angular rotation of the needle-holding cylinder corresponds with an identical angular rotation of the needle-holding plate.

The known knitting machines, even if during working they provide for the synchronous and constant rotation of the needle-holding cylinder and of the needle-holding plate, require that the needle-holding plate of the dial assembly can be offset with respect to the needle-holding cylinder in order to obtain specific textile processing. In more detail, the knitting machines of the above-described type (with needles in the plate) can typically operate in two work configurations:

- a first (normal work) configuration, in which cylinder and plate form normal knitwear, i.e. so-called "rib" knitwear;
- a second configuration, in which there is a transfer of knitwear stitches from the plate needle to the adjacent needles of the cylinder.

In the first configuration, when normal knitwear is formed, the plate needle—which as indicated above is located with its head between two underlying adjacent needles of the cylinder—must be centered on such two cylinder needles. By "centered" it is intended that, by observing the needles from top view, the plate needle is in the middle between two adjacent needles of the cylinder, and angularly equidistant therefrom.

Instead, when a transfer is carried out, the plate needle cannot stay centered on two cylinder needles since it it would not be possible to transfer the knitwear from the plate needle to the cylinder needles; it is necessary that the plate needle be brought close to the cylinder needle. Therefore, in order to reach the second configuration it is necessary to angularly offset the position of the needle-holding plate with respect to the position of the needle-holding cylinder (with respect to the first position), but of course this is carried out by maintaining the rotation synchronous (even if offset) between plate and cylinder, which continue to complete rotations of the same number of revolutions.

The known machines thus comprise a device for offsetting the position of the plate with respect to the position of the cylinder, i.e. in order to manage the passage between the above-illustrated first and second configurations.

In substance, assuming to have a reference notch on the plate and a respective reference notch on the cylinder (or two reference needles), such notches are in phase with respect to each other and rotate together without deviations when the machine is in the first configuration, while the intervention of the offset device ensures that the two notches can be angularly offset from each other in order to lead to the second configuration.

A known solution provides for angularly moving the plate needles, between two positions, by means of a pneumatic actuation that moves the entire dial assembly (i.e. the displacement of the needle-holding plate is obtained by moving the entire dial assembly). The two positions of the plate needles respectively correspond to the first and to the second operating configuration. Such pneumatic actuation is active on a set of gears placed in series along the aforesaid transmission means that form the rigid kinematic chain which transmits, to the plate, the rotation generated by the motor that moves the cylinder. Such intermediate set of gears comprises a plate with a series of idle wheels, which engage a main wheel: by rotating the set of gears all together with respect to an axis parallel to the axis of the knitting machine, one obtains a lateral offset of the engagement. A second known solution provides for dividing the rotation shaft of the needle-holding plate (which receives, from the transmission means, the rotation from the motor of the cylinder) into two half-shafts and inserting a gearbox between them, which by rotating offsets the lower half-shaft with respect to the upper half-shaft. Such box is entirely rotated (as a single block) from the outside, e.g. by means of a pneumatic piston, in order to obtain the offset between the shafts.

The Applicant has verified that the known solutions are not free of drawbacks and can be improved with regard to various aspects.

First of all, the known devices, when they introduce the offset and pass from the first to the second configuration, necessarily cause a loss of part of the engagement between the gears of the transmission chain, and thus introduce clearances and impact between the gears, which involve phenomena of wear and increased noise, as well as an imprecise transmission of the rotary motion to the needle-holding plate.

In addition, the known solutions can introduce errors in the synchronism between the rotation of the cylinder and that of the plate, or periodic changes in the two rotations due to the imprecise transmission of the motion. In general, the known solutions have the drawbacks of being structurally complex and/or subjected to phenomena of failure and/or difficult management by the operator and/or costly and/or difficult implementation on a knitting machine.

In general, the known solutions are complex from a structural standpoint and slow in causing the passage between the phasing and offset configurations.

In addition, the known solutions of pneumatic type only provide for the passage between the two configurations of phasing and of offset.

In this situation, the object underlying the present invention, in its various aspects and/or embodiments, is to provide a circular knitting machine that is able to overcome one or more of the abovementioned drawbacks.

Further object of the present invention is to provide a circular knitting machine in which it is possible to manage with greater flexibility the offset of the needle-holding plate with respect to the needle-holding cylinder, maintaining the synchronism in the rotation of plate and cylinder.

Further object of the present invention is to provide a circular knitting machine capable of transmitting with precision, and in each operating configuration, the rotary motion generated by the motor of the needle-holding cylinder to the needle-holding plate, ensuring a synchronous rotation of cylinder and plate.

Further object of the present invention is to provide a circular knitting machine that does not have, in the transmission chain of the rotation to the needle-holding plate, imprecise engagements.

Further object of the present invention is to provide a circular knitting machine in which it is possible to offset the needle-holding plate regardless of the operations performed, simultaneously, by the further devices of the dial assembly or of the needle-holding cylinder.

Further object of the present invention is to provide a circular knitting machine in which it is possible to manage with greater precision, in the different operating conditions and based on the textile requirements, the absorption of the thread during the formation of the knitwear on the cylinder of the needles and on the plate of the needles.

Further object of the present invention is to provide a circular knitting machine which allows optimizing the quality of the knitwear formed, for example by aligning or misaligning the rows of knitwear produced by the plate needles with respect to the rows of knitwear produced by the cylinder needles.

Further object of the present invention is to provide a circular knitting machine characterized by a high operation reliability and/or by a lower predisposition to failures and malfunctions.

Further object of the present invention is to provide a circular knitting machine characterized by a simple and rational structure, in particular of the dial assembly thereof.

Further object of the present invention is to provide a circular knitting machine which increases the possibilities of definition of the obtainable knitwear structures, based on the different textile requirements.

Further object of the present invention is to provide a circular knitting machine characterized by a limited attainment cost with respect to the offered performances and quality.

Further object of the present invention is that of creating alternative solutions, with respect to the prior art, in making circular knitting machines, and/or opening new design fields.

A further object of the present invention is to provide a circular knitting machine capable of allowing a new design of the devices for transmitting motion from the motor, which generates the rotation of the needle-holding cylinder, to the needle-holding plate.

Further object of the present invention is to provide a circular knitting machine characterized by a structure and a configuration that are innovative with respect to the prior art.

Such objects, and possibly others, which will be clearer in the course of the following description, are substantially achieved by a circular knitting machine according to one or more of the enclosed claims, each of which taken separately (without the relative dependent claims) or in any combination with the other claims, as well as according to the following aspects and/or embodiments, variously combined, also with the aforesaid claims.

In the present description and in the enclosed claims, the terms "upper", "above", "lower", "below", "vertical", "vertically", "horizontal", "horizontally", "radial", "radially", relate to the positioning of the machine in the normal operation with the central axis of rotation placed vertically, the cylinder needles arranged vertically with the heads directed upward, and the plate needles arranged horizontally with the respective heads directed towards the outside of the needle-holding plate.

Aspects of the invention are listed hereinbelow.

In a first aspect thereof, the invention regards a circular knitting machine for knitted or hosiery items, comprising:

- a supporting structure;
- at least one needle-holding cylinder turnably mounted in said supporting structure and selectively rotatable around an axis of rotation of the knitting machine;
- a plurality of cylinder needles supported by said needle-holding cylinder and movable, in respective sliding seats of the cylinder, in order to produce a knitted fabric;
- a dial assembly, or dial assembly, arranged above said needle-holding cylinder and comprising.

In one aspect the dial assembly comprises:

- a supporting ring integral with said supporting structure and coaxial with said needle-holding cylinder;
- a needle-holding plate turnably mounted on said supporting ring so as to be able to rotate around a respective axis of rotation coinciding with said axis of rotation of the knitting machine;
- a plurality of plate needles supported by said needle-holding plate and movable, in respective sliding seats of the plate, in order to produce a knitted fabric.

In one aspect the knitting machine comprises motion generation elements configured for rotating said needle-holding cylinder around the axis of rotation.

In one aspect the knitting machine comprises motion transmission elements, operatively located between said motion generation elements and said dial assembly and configured for forming a motion transmission chain capable of transmitting, to the needle-holding plate, the rotation generated by the motion generation elements, in a manner such that the needle-holding cylinder and the needle-holding plate synchronously rotate, i.e. in a manner such that a specific angular rotation of the needle-holding cylinder corresponds with an identical angular rotation of the needle-holding plate.

In one aspect the motion transmission elements comprise:

- at least one first toothed wheel, receiving the rotary motion of the motion generation elements;
- at least one second toothed wheel, placed downstream of said first toothed wheel along the motion transmission chain, and mounted coaxially with the needle-holding plate in a manner such that a rotation of the second toothed wheel corresponds with a same rotation of the needle-holding plate;
- at least one offset device, located between said first toothed wheel and said second toothed wheel.

In one aspect the offset device comprises:

- an inlet gear, engaged with said first toothed wheel so as to be put in rotation by the first toothed wheel;
- an outlet gear, engaged with said second toothed wheel so as to place in rotation the second toothed wheel.

In one aspect the inlet gear and the outlet gear are mounted coaxially with one another, so as to rotate around an axis of the offset device.

In one aspect the offset device comprises an actuator acting upon the inlet gear and/or upon the outlet gear so as to shift selectively, and in a controlled manner, at least one of said inlet and outlet gears along the axis of the offset device, so as to change the engagement of the inlet gear with the first toothed wheel and/or the engagement of the outlet gear with the second toothed wheel.

In one aspect the inlet gear and the outlet gear are integral with each other and the actuator is active both on the inlet gear and on the outlet gear so as to shift them integrally along the axis of the offset device, so as to change the engagement of the inlet gear with the first toothed wheel and the engagement of the outlet gear with the second toothed wheel.

In one aspect the inlet gear and the first toothed wheel have a same first toothing, said first toothing being composed of non-linear teeth, i.e. having a transverse extension with respect to directions parallel to the axis of the offset device (angled teeth).

In one aspect said first toothing is composed of helical teeth.

In one aspect the outlet gear and the second toothed wheel have a same second toothing, said second toothing being composed of non-linear teeth, i.e. having a transverse extension with respect to directions parallel to the axis of the offset device (angled teeth).

In one aspect said second toothing is composed of helical teeth.

In one aspect said first toothing and said second toothing are of the same type, and the first wheel, the inlet gear, the outlet gear and the second wheel all have a geometrically uniform toothing.

In one aspect the inlet gear and the outlet gear are mounted coaxially with one another, in the offset device, and opposed so as to exhibit toothings oriented in opposed directions, i.e. the first toothing and the second toothing are specular one to the other with respect to a median plane perpendicular to the axis of the offset device and located between the inlet gear and the outlet gear.

In one aspect the inlet gear and the outlet gear overall constitute a double gear with opposed integral wheels.

In one aspect the actuator of the offset device, when it controls the shift of the inlet gear and/or of the outlet gear:

introduces a change of engagement of the outlet gear with the second toothed wheel and keeps the engagement of the inlet gear with the first toothed wheel, the change of engagement causing an angular forward or backward movement of the second toothed wheel, when engaged with the outlet gear, with respect to the direction of rotation, maintaining a continuous transmission of the rotation and the synchronism of the rotary motion generated by the motion generation elements for the needle-holding plate coaxial with the second toothed wheel; and/or introduces a change of engagement of the inlet gear with the first toothed wheel and keeps the engagement of the outlet gear with the second toothed wheel, the change of engagement causing at the outlet an angular forward or backward movement of the second toothed wheel, with respect to the direction of rotation, maintaining a continuous transmission of the rotation and the synchronism of the rotary motion generated by the motion generation elements for the needle-holding plate coaxial with the second toothed wheel.

In one aspect the actuator of the offset device, when it controls the integral shift of the inlet gear and of the outlet gear, introduces a change of engagement of the outlet gear with the second toothed wheel, maintaining the engagement of the inlet gear with the first toothed wheel, such change being due to the fact that the first toothing and the second toothing are composed of non-linear teeth, preferably helical, the change of engagement causing an angular forward or backward movement of the second toothed wheel, when engaged with the outlet gear, with respect to the direction of rotation, maintaining a continuous transmission of the rotation and the synchronism of the rotary motion generated by the motion generation elements for the needle-holding plate coaxial with the second toothed wheel.

In one aspect the offset device is configured for axially moving, along said axis of the offset device, the inlet gear and the outlet gear at least between:

a first operating position, in which the outlet gear and the second toothed wheel exhibit between them a first engagement which positions the needle-holding plate with respect to the needle-holding cylinder, both rotating synchronously, in a first operating configuration, in which each plate needle is located between two underlying adjacent needles of the cylinder at specific angular distances therefrom;

a second operating position, axially shifted with respect to the first operating position, in which the outlet gear and the second toothed wheel exhibit between them a second engagement which positions the needle-holding plate with respect to the needle-holding cylinder, both rotating synchronously, in a second operating configuration, in which each plate needle is located between two underlying adjacent needles of the cylinder in an angularly offset position with respect to the position taken in said first operating configuration.

In one aspect the offset device is operatively acting upon the inlet gear and upon the outlet gear so as to axially move them at least between:

a phasing position, in which the engagement between the outlet gear and the second toothed wheel positions the needle-holding plate, rotating with the needle-holding cylinder, with the plate needles centered on two adjacent needles of the cylinder, i.e. with each plate needle substantially in the middle between two respective adjacent needles of the cylinder, and angularly equidistant therefrom; and/or a delayed position, in which the engagement between the outlet gear and the second toothed wheel positions the needle-holding plate, rotating with the needle-holding cylinder, angularly moved backward with respect to said phasing position, with respect to the direction of rotation of the cylinder and of the plate, each plate needle being near the cylinder needle—of the two respective adjacent needles of the cylinder between which it is located—following the same along the direction of rotation of the cylinder; and/or an advanced position, in which the engagement between the outlet gear and the second toothed wheel positions the needle-holding plate, rotating with the needle-holding cylinder, angularly advanced with respect to said phasing position, with respect to the direction of rotation of the cylinder and of the plate, each plate needle being near the cylinder needle—of the two respective adjacent needles of the cylinder between which it is located—preceding the same along the direction of rotation of the cylinder.

In one aspect the offset device is configured for axially moving the inlet gear and/or the outlet gear up to a specific offset position, in which the engagement between the outlet gear and the second toothed wheel, and/or the engagement between the inlet gear and the first toothed wheel, positions the needle-holding plate, rotating with the needle-holding cylinder, angularly advanced or moved backward with respect to the phasing position by an angular quantity such that each plate needle is offset with respect to the adjacent needles of the cylinder (of the phasing position) by an angle greater than the angular distance between two adjacent needles of the cylinder, and/or greater than the angular distance between three consecutive needles of the cylinder, and/or greater than the angular distance between more than three consecutive needles of the cylinder.

In substance, the offset of the plate needles with respect to the cylinder needles, introduced by the offset device, can be greater than a needle pitch of the cylinder (where the needle pitch is the angular distance between two adjacent needles of the cylinder), or greater than two needle pitches, or greater than three needle pitches, or higher, with a greater number of needle pitches.

In one aspect, the inlet gear and the outlet gear are axially moved by said actuator so as to cover an axial travel, each axial position of said axial travel corresponding to a different operating position.

In one aspect said delayed position and said advanced position, taken by the inlet and outlet gears along said axial travel, are on opposed sides with respect to the phasing position.

In one aspect the delayed position and the advanced position are positions in which the change of engagement between outlet gear and second toothed wheel causes an offset of the position of the plate needles with respect to the cylinder needles.

In one aspect the phasing position corresponds to said first operating position and the delayed position or the advanced position corresponds to said second operating position.

In one aspect the advanced position corresponds to said first operating position and the delayed position corresponds to said second operating position, the phasing position being a third intermediate operating position between said first and said second operating positions.

In one aspect said first and said second operating positions constitute axial end positions, along said axial travel, reachable by the inlet gear and by the outlet gear in their movement along said axial travel due to said actuator of the offset device.

In one aspect the offset device is operatively acting upon the inlet gear and upon the outlet gear, integral with each other, so as to selectively move them and in a continuous manner among a plurality of operating positions, each characterized by a specific axial positioning of the gears along the axis of the offset device, and in which the change of engagement occurs in a continuous manner between successive positions.

In one aspect the inlet and outlet gears can be axially moved in a continuous manner between the plurality of operating positions so as to introduce an incremental offset on the angular positions of the plate needles with respect to the cylinder needles, with plate and cylinder rotating synchronously.

In one aspect the angular offset width of the plate needles with respect to the cylinder needles, obtainable with said axial travel which the inlet and outlet gears can move as a result of the translational motion imparted thereto by said actuator, is at least 0.01°, and/or at least 0.1°, and/or at least 0.5°, and/or at least 1°, and/or at least 2°, and/or at least 4°, and/or at least 12°, and/or at least 20°.

In one aspect the dial assembly comprises one or more of the following additional devices, preferably mounted on said supporting ring:

- one or more gripper assemblies, each comprises one or more movable grippers, configured for retaining or blocking a thread supplied to the needles of the knitting machine, and actuators, preferably pneumatic, which move such grippers;
- one or more cutting devices, or "thread-trimmer knives", each provided with a cutting element configured for cooperating with said knife in order to execute the cutting of the threads transported by the knife itself;
- one or more thread suction devices, or "thread suction pipes", configured for suctioning the threads of one or more feeds and the relative fluff.

In one aspect the sliding seats of the cylinder, housing the cylinder needles, are longitudinal grooves in the needle-holding cylinder, preferably parallel to the axis of rotation, and the sliding seats of the plate, housing the plate needles, are radial grooves in the needle-holding plate, centered on said axis of rotation.

In one aspect the cylinder needles are movable parallel to the axis of rotation, i.e. vertically, and the plate needles are movable radially with respect to the axis of rotation, i.e. horizontally.

In one aspect said offset device is integral with the supporting structure of the knitting machine and is fixed when the knitting machine is in use (except for the movable parts of the actuator and of the two translating gears).

In one aspect said actuator, operatively active on the inlet and outlet gears so as to selectively move them between the aforesaid operating positions, is preferably an electric motor.

In one aspect the first toothed wheel is integral with the supporting structure of the knitting machine and is maintained in fixed position while it rotates around the axis thereof.

In one aspect the second toothed wheel is mounted on the dial assembly and is maintained in fixed position while it rotates around the axis of rotation of the knitting machine.

In one aspect, the teeth of the outlet gear constitute a plurality of cams distributed all around the gear itself and engaging with the teeth of the second toothed wheel, in a manner such that an axial shift of the outlet gear causes a pushing action by said plurality of cams on the teeth of the second toothed wheel, said push causing an angular advancement or an angular moving backward of the second toothed wheel, maintaining a correct engagement of the outlet gear with the second toothed wheel.

In one aspect, an axial shift of the outlet gear in a first direction, along the axis of the offset device, corresponds with an angular advancement, in accordance with the direction of rotation, of the second toothed wheel, and an axial shift of the outlet gear in a second direction, opposed to said first direction along the axis of the offset device, corresponds with an angular moving backward, in accordance with the direction of rotation, of the second toothed wheel.

In one aspect, the greater the axial shift of the outlet gear, the greater the angular offset of the second toothed wheel.

In one aspect, the angular offset of the second toothed wheel changes proportionally, preferably in a linear manner, as a function of the value of axial shift of the outlet gear.

In one aspect the teeth of the outlet gear constitute multiple cams engaging in succession with the teeth of the second toothed wheel, which allow maintaining a correct engagement also following an axial shift of the outlet gear with respect to the second toothed wheel.

In one aspect, the teeth of the inlet gear constitute a plurality of cams distributed all around the gear itself and engaging with the teeth of the first toothed wheel, in a manner such that an axial shift of the inlet gear causes a pushing action by said plurality of cams on the teeth of the first toothed wheel, said push causing an angular advancement or an angular moving backward of the first toothed wheel, maintaining a correct engagement of the inlet gear with the first toothed wheel.

In one aspect, an axial shift of the inlet gear in a first direction, along the axis of the offset device, corresponds with an angular advancement, in accordance with the direction of rotation, of the first toothed wheel, and an axial shift of the inlet gear in a second direction, opposed to said first direction along the axis of the offset device, corresponds with an angular moving backward, in accordance with the direction of rotation, of the first toothed wheel.

In one aspect, the greater the axial shift of the inlet gear, the greater the angular offset of the first toothed wheel.

In one aspect, the angular offset of the first toothed wheel changes proportionally, preferably in a linear manner, as a function of the value of axial shift of the inlet gear.

In one aspect the teeth of the inlet gear constitute multiple cams engaging in succession with the teeth of the first toothed wheel, which allow maintaining a correct engagement also following an axial shift of the inlet gear with respect to the first toothed wheel.

In one aspect the teeth of the inlet gear, of the outlet gear, of the first toothed wheel and of the second toothed wheel have a circular involute profile.

In one aspect the offset device is physically located between the first toothed wheel and the second toothed wheel, and engages with both along said motion transmission chain, so as to transmit a continuous rotary motion from the first toothed wheel to the second toothed wheel, with possibility of angular offset of the second toothed wheel mounted coaxially with the needle-holding plate.

In one aspect the teeth of the inlet gear, of the outlet gear, of the first toothed wheel and of the second toothed wheel all have a same toothing.

In one aspect the inlet gear, the outlet gear, the first toothed wheel and the second toothed wheel are all driven wheels, which receive a rotary motion from said motion generation elements (e.g. from a drive wheel connected to the main motor) and transmit it along said transmission chain.

In one aspect said axis of the offset device is parallel to said axis of rotation of the knitting machine.

In one aspect the axis of rotation of the first toothed wheel and of the second toothed wheel are parallel to each other and to said axis of the offset device (and to said axis of rotation of the knitting machine).

In one aspect the inlet gear is vertically superimposed on the outlet gear.

In one alternative aspect, the outlet gear is vertically superimposed on the inlet gear.

In one aspect the supporting structure of the knitting machine comprises a support frame, with which at least one part of said motion transmission elements are mounted.

In one aspect the inlet gear and the outlet gear are structurally identical to each other.

In one aspect the knitting machine comprises a control unit configured for interacting with the offset device.

In one aspect the control unit is configured for programming and/or maintaining a specific offset between the needle-holding plate and the needle-holding cylinder, on the basis of the axial position of the inlet and/or outlet gears shifted by the actuator 25, and suitably driving the position of the actuator.

In one aspect the control unit is configured for achieving a feedback control of the position of the plate with respect to the cylinder, dynamically modifying, and in a continuous manner over time, the axial position of the inlet and/or outlet gears by means of the actuator, in order to maintain a mutual positioning between the plate and the cylinder.

In one aspect the knitting machine comprises a plurality of feeds, or thread feed points, in which the thread is supplied to the needles of the machine, the feeds being positioned circumferentially around the component-holding element and angularly spaced from each other.

In an independent aspect thereof, the present invention regards an offset device according to one or more of the aforesaid aspects and/or claims, intended to be installed in a circular knitting machine for knitted or hosiery items.

Each of the aforesaid aspects of the invention can be taken separately or in combination with any one of the claims or of the other described aspects.

Further characteristics and advantages will be clearer from the detailed description of several embodiments, also including a preferred embodiment, given as non-exclusively examples of a circular knitting machine in accordance with the present invention. Such description will be set forth hereinbelow with reference to the enclosed drawings, provided only as a non-limiting example, in which:

FIG. 1 shows a view of a possible embodiment of a circular knitting machine according to the present invention, with some parts removed and partially sectioned (along a vertical plane passing through the axis of rotation of the needle-holding cylinder and of the needle-holding plate); in particular the following are shown: the dial assembly, provided with the plate of the needles, the underlying needle-holding cylinder (partially), and the elements for transmitting rotary motion to the dial assembly; in FIG. 1 the plate of the needles is situated in a first operating configuration;

FIG. 2 is a schematic section, carried out on the II-II plane perpendicular to the axis of rotation, of the knitting machine of FIG. 1; in particular, the arrangement is shown of the plate needles with respect to the cylinder needles, with the plate in the first operating configuration;

FIG. 3, analogous to FIG. 1, shows a view of the circular knitting machine of FIG. 1, with some parts removed and sectioned, and with the plate of the needles in a second operating configuration;

FIG. 4 is a schematic section, carried out on the plane IV-IV perpendicular to the axis of rotation, of the knitting machine of FIG. 3; in particular, the arrangement is shown of the plate needles with respect to the cylinder needles, with the plate in the second operating configuration.

With reference to the abovementioned figures, reference number 1 overall indicates a circular knitting machine in accordance with the present invention. In general, the same reference number is used for identical elements or the like, possibly in the embodiment variants thereof.

FIG. 1 shows a possible embodiment of a knitting machine according to the present invention, with some parts removed. In particular, the illustration of the machine is focused on the dial assembly and on the needle-holding cylinder, so as to allow comprehending the present invention.

The base of the knitting machine, the section comprising the processing control unit, further components of the knitting head and of the needle-holding cylinder, its elements for generating the rotation for the needle-holding cylinder and for the needle-holding plate and other parts of the knitting machine are not shown in detail in the figures, since they are per se known and of conventional type. From a textile technology standpoint, the operation of the entire knitting machine (e.g. the operation of the needle-holding cylinder, the cooperation between needles and threads, etc.) is not described in detail, since it is known in the technical field of the present invention.

The knitting machine 1 comprises a supporting structure, a needle-holding cylinder C turnably mounted in the supporting structure and selectively rotatable around an axis of rotation X of the knitting machine, and a plurality of cylinder needles N1 supported by the needle-holding cylinder and movable, in respective sliding seats 2 of the cylinder, in order to produce a knitted fabric.

The knitting machine 1 also comprises a dial assembly 3, arranged above the needle-holding cylinder C.

The dial assembly 3 comprises a supporting ring integral with the supporting structure and coaxial with the needle-holding cylinder C; the supporting ring constitutes a fixed frame of the dial assembly, which remains stopped with knitting machine in use.

The dial assembly 3 comprises:

- a needle-holding plate P turnably mounted on the supporting ring so as to be able to rotate around a respective axis of rotation coinciding with the axis of rotation X of the knitting machine;
- a plurality of plate needles N2 supported by the needle-holding plate P and movable, in respective sliding seats 5 of the plate P, in order to produce a knitted fabric.

Preferably the dial assembly 3 comprises an element for transporting and cutting threads, or "knife", mounted outside the supporting ring and integral with the needle-holding plate P, so as to rotate together therewith.

The knitting machine 1 also comprises:

- motion generation elements (not shown, for example of known type) configured for rotating the needle-holding cylinder C around the axis of rotation X;
- motion transmission elements 10, operatively located between the motion generation elements and the dial assembly 3 and configured for forming a motion transmission chain capable of transmitting to the needle-holding plate P the rotation generated by the motion generation elements, in a manner such that the needle-holding cylinder C and the needle-holding plate P synchronously rotate, i.e. in a manner such that a specific angular rotation of the needle-holding cylinder C corresponds with an identical angular rotation of the needle-holding plate P.

The motion generation elements typically comprise an electric main motor capable of placing in rotation the needle-holding cylinder and, by means of the motion transmission elements, also the needle-holding plate.

As indicated above, it is necessary—for the correct operation of the knitting machine—that a rigid kinematic chain be present which transmits to the needle-holding plate, synchronously with respect to the cylinder, the rotation generated by the aforesaid main motor.

For such purpose, the motion transmission elements 10 of the knitting machine 1 comprise:

- a first toothed wheel 11, which receives the rotary motion of the motion generation elements;
- a second toothed wheel 12, placed downstream of the first toothed wheel 11 along the motion transmission chain, and mounted coaxially with the needle-holding plate P in a manner such that a rotation of the second toothed wheel 12 corresponds with a same rotation of the needle-holding plate P;
- an offset device 20, located between the first toothed wheel 11 and the second toothed wheel 12, and comprising:
  - an inlet gear 21, engaged with the first toothed wheel 11 so as to be put in rotation thereby;
  - an outlet gear 22, engaged with the second toothed wheel 12 so as to place it in rotation.

As can be observed in FIGS. 1 and 3, the inlet gear 21 and the outlet gear 22 are mounted coaxially with one another, so as to rotate both around an axis of the offset device (such axis being identified as Y).

The offset device 20 also comprises an actuator 25 active at least on one between the inlet gear and the outlet gear, or preferably on both, so as to shift selectively, and in a controlled manner, the inlet gear and/or the outlet gear along the axis of the offset device;

In such a manner, a change is obtained of the engagement of the inlet gear 21 with the first toothed wheel 11 and/or of the engagement of the outlet gear 22 with the second toothed wheel 12.

Preferably, as shown as an example in FIGS. 1 and 3, the inlet gear 21 and the outlet gear 22 are integral with each other and the actuator 25 is active, simultaneously, and in the same manner, both on the inlet gear 21 and on the outlet gear 22 so as to shift them integrally along the axis Y of the offset device 20, so as to change both the engagement of the inlet gear with the first toothed wheel, and the engagement of the outlet gear with the second toothed wheel.

In each case, in accordance with the technical solution underlying the present invention, it is sufficient that one of the two gears 21 or 22, engaging the respective toothed wheel 11 or 12, be axially translatable along the axis Y and be provided with non-linear teeth; even only with one of the two translatable gears, one obtains a change of the engagement which—as illustrated hereinbelow as well—causes an offset of the plate with respect to the cylinder, maintaining a continuous and synchronous rotation. In such sense, once the pair of wheels is identified at which the offset occurs (by means of change of the engagement following the axial shift), the remaining wheels of the transmission elements can also have straight teeth.

Preferably the inlet gear 21 and the first toothed wheel 11 have a same first toothing 31, and such first toothing 31 is composed of non-linear teeth, i.e. having a transverse extension with respect to directions parallel to the axis of the offset device Y. In other words, the teeth of the first toothing 31 are preferably "angled" teeth, i.e. not having a vertical extension.

More preferably, the first toothing 31 is composed of helical teeth.

Preferably the outlet gear 22 and the second toothed wheel 12 have a same second toothing 32, and such second toothing 32 is composed of non-linear teeth, i.e. having a transverse extension with respect to directions parallel to the axis of the offset device. In other words, the teeth of the second toothing 32 are preferably "angled" teeth, i.e. not having a vertical extension.

More preferably, the second toothing 32 is composed of helical teeth.

In one possible embodiment, as shown as an example in the figures, the first toothing 31 and the second toothing 32 are equivalent to each other, and the first toothed wheel 11, the inlet gear 21, the outlet gear 22 and the second toothed wheel 12 all have a toothing of the same type.

Preferably, the inlet gear 21 and the outlet gear 22 are mounted coaxially with one another, in the offset device 20, and opposed so as to exhibit toothings oriented in opposed directions, i.e. the first toothing 31 and the second toothing 32 are specular one to the other with respect to a median plane M perpendicular to the axis Y of the offset device and located between the inlet gear 21 and the outlet gear 22.

In such a manner, the inlet gear 21 and the outlet gear 22 overall make a double gear with opposed integral wheels.

Reference will now be made to the case in which both the inlet 21 and outlet 22 gears are integral and translate together due to the actuator 25, as shown as an example in the figures.

In such case, the actuator 25 of the offset device 20, when it controls the integral shift of the inlet gear 21 and of the outlet gear 22, introduces a change of engagement of the outlet gear 22 with the second toothed wheel 12, maintaining the engagement of the inlet gear 21 with the first toothed wheel 11; such change is due to the fact that the first toothing 31 and the second toothing 32 are composed of non-linear teeth, preferably helical, and the change of engagement causes an angular forward or backward movement of the second toothed wheel 12, when engaged with the outlet gear 22, with respect to the direction of rotation, maintaining a continuous transmission of the rotation and the synchronism of the rotary motion generated by the motion generation elements for the needle-holding plate P coaxial with the second toothed wheel 12.

Preferably the offset device 20 is configured for axially moving, along the axis of the offset device Y, the inlet gear 21 and the outlet gear 22 at least between:

- a first operating position, in which the outlet gear 22 and the second toothed wheel 12 exhibit between them a first engagement that positions the needle-holding plate P with respect to the needle-holding cylinder C, both rotating synchronously, in a first operating configuration, in which each needle N2 of the plate P is located between two underlying, adjacent needles N1 of the cylinder C at specific angular distances therefrom;
- a second operating position, axially shifted with respect to the first operating position, in which the outlet gear 22 and the second toothed wheel 12 exhibit between them a second engagement that positions the needle-holding plate P with respect to the needle-holding cylinder C, both rotating synchronously, in a second operating configuration, in which each needle N2 of the plate P is located between two underlying, adjacent needles N1 of the cylinder C in an angularly offset position with respect to the position taken in said first operating configuration.

Preferably the offset device 20 is operatively acting upon the inlet gear 21 and upon the outlet gear 22 so as to axially move them at least between:

- a phasing position, in which the engagement between the outlet gear 22 and the second toothed wheel 12 positions the needle-holding plate P, rotating with the needle-holding cylinder C, with the plate needles N2 centered on two adjacent needles N1 of the cylinder, i.e. with each needle N2 of the plate P substantially in the middle between two respective adjacent needles N1 of the cylinder C, and angularly equidistant therefrom;
- a delayed position, in which the engagement between the outlet gear 22 and the second toothed wheel 12 positions the needle-holding plate P, rotating with the needle-holding cylinder C, angularly moved backward with respect to said phasing position, with respect to the direction of rotation of the cylinder and of the plate, each needle N2 of the plate P being near the needle N1 of the cylinder C—of the two respective adjacent needles of the cylinder between which it is located—following the same along the direction of rotation of the cylinder;
- an advanced position, in which the engagement between the outlet gear 22 and the second toothed wheel 12 positions the needle-holding plate P, rotating with the needle-holding cylinder C, angularly advanced with respect to said phasing position, with respect to the direction of rotation of the cylinder and of the plate, each needle N2 of the plate P being near the needle N1 of the cylinder C—of the two respective adjacent needles of the cylinder between which it is located—preceding the same along the direction of rotation of the cylinder. It is observed that in the aforesaid phasing position between cylinder C and plate P, typically cylinder and plate form normal knitwear, i.e. so-called "rib" knitwear (FIGS. 1 and 2). In such normal operating conditions the needles N2 of the plate P are located (observing the section of FIG. 2 from above) exactly halfway between the N1 of the cylinder C, with a precise alternation between plate needles and cylinder needles.

It is also observed that the aforesaid advanced position of the plate P with respect to the cylinder C is typically engaged in order to execute a transfer of knitwear stitches from one or more needles N2 of the plate P to the respective adjacent needles N1 of the cylinder C (FIGS. 3 and 4).

Preferably, the inlet gear 21 and the outlet gear 22 are axially moved by the actuator 25 so as to cover an axial travel, and each axial position of such axial travel corresponds to a different operating position.

Preferably the aforesaid delayed position and the aforesaid advanced position, induced by the inlet 21 and outlet 22 gears along the axial travel, are on opposed sides with respect to the phasing position.

Preferably the delayed position and the advanced position are positions in which the change of engagement between outlet gear 22 and second toothed wheel 12 causes an offset of the position of the needles N2 of the plate P with respect to the needles N1 of the cylinder C.

Preferably the phasing position corresponds to the aforesaid first operating position and the delayed position, or the advanced position, corresponds to the aforesaid second operating position.

In one embodiment, the advanced position corresponds to the first operating position and the delayed position corresponds to the second operating position, the phasing position being a third intermediate operating position between the first and the second operating position.

The first and the second operating position can also constitute axial end positions, along said axial travel, reachable by the inlet gear 21 and by the outlet gear 22 in their movement along the axial travel due to the actuator 25 of the offset device.

Preferably the offset device 20 is operatively acting upon the inlet gear 21 and upon the outlet gear 22, integral with each other, so as to selectively move them and in a continuous manner among a plurality of operating positions, each characterized by a specific axial positioning of the gears along the axis of the offset device Y: in such case the change of engagement occurs in a continuous manner between successive positions.

Preferably the inlet 21 and outlet 22 gears can be axially moved in a continuous manner between the plurality of operating positions so as to introduce, selectively, an incremental offset on the angular positions of the needles N2 of the plate P with respect to the needles N1 of the cylinder C, with plate P and cylinder C rotating synchronously.

Preferably the angular offset width of the needles N2 of the plate P with respect to the needles N1 of the cylinder C, obtainable with the axial travel which the inlet 21 and/or outlet 22 gears can move as a result of the translational motion imparted thereto by the actuator 25, is at least 0.01°, or at least 0.1°, or at least 1°, or at least 2°, or at least 4°, or at least 12°, or at least 20°, or greater angles based on the requirements. Preferably the dial assembly 3 comprises one or more of the following additional devices, preferably mounted on said supporting ring:

- one or more gripper assemblies, each comprises one or more movable grippers, configured for retaining or blocking a thread supplied to the needles of the knitting machine, and actuators, preferably pneumatic, which move such grippers;
- one or more cutting devices, or "thread trimmer knives", each provided with a cutting element configured for cooperating with said knife in order to execute the cutting of the threads transported by the knife itself;
- one or more thread suction devices, or "thread suction pipes", configured for suctioning the threads of one or more feeds and the relative fluff.

Preferably the sliding seats 2 of the cylinder C, housing the needles N1 of the cylinder, are longitudinal grooves in the needle-holding cylinder C, preferably parallel to the axis of rotation X, and the sliding seats 5 of the plate P, housing the plate needles N2, are radial grooves in the needle-holding plate P, centered on the axis of rotation X.

Preferably the needles N1 of the cylinder C are movable parallel to the axis of rotation X, i.e. vertically, and the needles N2 of the plate P are movable radially with respect to the axis of rotation X, i.e. horizontally.

Preferably the offset device 20 is integral with the supporting structure of the knitting machine and is fixed when the knitting machine is in use (except for the movable parts of the actuator 25 and of the two translating gears 21 and 22).

Preferably the actuator 25, operatively active on the inlet 21 and/or outlet 22 gears so as to selectively move them between the aforesaid operating positions, is preferably an electric motor, as an example a stepper motor.

Preferably the motor is provided with a suitable transmission capable of transforming the rotary motion of the motor into translational motion of the gears.

In one possible embodiment, the actuator comprises a screw-nut screw transmission coupled to the inlet 21 and outlet 22 gears; such transmission receives a rotary motion from the electric motor (of rotating type) and transfers a linear motion to the gears (along the axis Y).

As an example, the actuator can comprise a linear electric motor active on the gears 21 and 22, or a pneumatic actuation.

Preferably the first toothed wheel 11 is integral with the supporting structure of the knitting machine and is maintained in fixed position while it rotates around the axis thereof. Preferably the second toothed wheel 12 is mounted on the dial assembly and is maintained in an axially fixed position while it rotates around the axis of rotation of the knitting machine.

Preferably, the teeth of the outlet gear 22 (and/or of the inlet gear 21) constitute a plurality of cams 50 distributed all around the gear itself and engaging with the teeth of the second toothed wheel 12 (and/or of the first toothed wheel 11), in a manner such that an axial shift of the outlet gear causes a pushing action by said plurality of cams on the teeth of the second toothed wheel, said push causing an angular advancement or an angular moving backward of the second toothed wheel, maintaining a correct engagement of the outlet gear with the second toothed wheel.

Preferably, an axial shift of the outlet gear 22 in a first direction, along the axis of the offset device Y, correspond with an angular advancement, with respect to the direction of rotation, of the second toothed wheel 12, and an axial shift of the outlet gear in a second direction, opposed to the first direction along the axis of the offset device Y, corresponds with an angular moving backward, with respect to the direction of rotation, of the second toothed wheel.

Preferably, the greater the axial shift of the outlet gear 22, the greater the angular offset of the second toothed wheel 12.

Preferably, the angular offset of the second toothed wheel 12 changes proportionally, preferably in a linear manner, as a function of the value of axial shift of the outlet gear 22.

From a mechanical and functional standpoint, the teeth of the outlet gear 22 (and/or of the inlet gear 21) constitute multiple cams engaging in succession with the teeth of the second toothed wheel 12 (and/or of the first toothed wheel 11), which allow maintaining a correct engagement also following an axial shift of the outlet gear (respectively inlet gear) with respect to the second toothed wheel (respectively first toothed wheel).

It is observed, as illustrated above, that the analogy between non-linear teeth of the gears and cams rotating and engaging in succession is valid both for the outlet gear/second toothed wheel pair, and for the inlet gear/first toothed wheel pair, depending on the implemented embodiment.

It is also observed that the passage between the aforesaid operating positions (e.g. from phasing position to advanced or delayed position) occurs with an offset transient period: such transient period has a brief duration, for example equal to about a knitwear row, is recovered during the formation of the knitwear without creating problems or introducing imprecisions in the working.

As an example, as shown in the figures, the teeth of the inlet gear 21, of the outlet gear 22, of the first toothed wheel 11 and of the second toothed wheel 12 have a circular involute profile.

Preferably the offset device 20 is physically located between the first toothed wheel 11 and the second toothed wheel 12, and engages with both along the aforesaid motion transmission chain, so as to transmit a continuous rotary motion from the first toothed wheel 11 to the second toothed wheel 12, with possibility of angular offset of the second toothed wheel mounted coaxially with the needle-holding plate.

As an example the teeth of the inlet gear 21, of the outlet gear 22, of the first toothed wheel 11 and of the second toothed wheel 12 all have a same toothing.

Preferably the teeth of the inlet gear 21 and of the first toothed wheel 11 are of helical type with constant pitch, and geometrically identical to each other.

Preferably the teeth of the outlet gear 22 and of the second toothed wheel 12 are of helical type with constant pitch, and geometrically identical to each other.

Preferably the inlet gear 21 and the outlet gear 22 are structurally identical to each other.

Preferably the axis of the offset device Y is parallel to the axis of rotation X of the knitting machine 1. Preferably the respective axes of rotation of the first toothed wheel 11 and of the second toothed wheel 12 are parallel to each other and to the axis of the offset device Y (and to the axis of rotation X of the knitting machine).

Preferably the inlet gear 21 is vertically superimposed on the outlet gear 22. Alternatively, the outlet gear 22 can be vertically superimposed on the inlet gear 21.

Preferably the inlet gear 21, the outlet gear 22, the first toothed wheel 11 and the second toothed wheel are all driven wheels, which receive a rotary motion of the motion generation elements (e.g. from a drive wheel connected to the main motor) and transmit it along the aforesaid transmission chain.

Preferably the motion transmission elements 10 can comprise further toothed wheels or gears, in order to correctly manage and transfer the rotation generated by the main motor to the dial assembly.

For example, as shown in the figures, the motion transmission elements 10 can comprise a third toothed wheel 13, placed upstream of the first toothed wheel 11 along the motion transmission chain; such third wheel 13 receives the rotary motion of the motion generation elements and transmits it to the first toothed wheel. Typically the third wheel 13 is a drive wheel.

The presence of further toothed wheels or gears (e.g. the third toothed wheel 13) can be due to the fact that it is necessary to reach the end of the motion transmission chain, i.e. the needle-holding plate P, with a motion directed in the correct direction of rotation (clockwise or counter-clockwise), in a manner such that cylinder C and plate P rotate not just synchronously but also in the same direction of rotation. Since each pair of engaging wheels introduces—while it transmits the motion—a reversal of the direction of rotation, it may be necessary to introduce auxiliary idle wheels. Another reason can be the need to manage interaxle distances, empty spaces and distances between the gears, by introducing suitable auxiliary wheels.

Preferably the supporting structure of the knitting machine comprises a support frame T, with which at least one part of the motion transmission elements 10 is mounted. FIGS. 1 and 3 show as an example a support frame T (integral with the supporting structure) with which the following are mounted: the first 11 toothed wheel, the third toothed wheel 13, the movement device 20 with the actuator 25 and the gears 21 and 22, the dial assembly 3 with the second toothed wheel 12.

Preferably the knitting machine comprises a control unit (not shown, for example of known type) configured for interacting with the offset device 20.

Preferably the control unit is configured for programming and/or maintaining a specific offset between the needle-holding plate P and the needle-holding cylinder C, on the basis of the axial position of the inlet and/or outlet gears shifted by the actuator 25, and suitably driving the position of the actuator.

Preferably the control unit is configured for achieving a feedback control of the position of the plate P with respect to the cylinder C, dynamically modifying, and in a continuous manner over time, the axial position of the inlet and/or outlet gears by means of the actuator, in order to maintain a mutual positioning between the plate and the cylinder.

The invention thus conceived is susceptible of numerous modifications and variations, all falling within the scope of the inventive concept, and the abovementioned components are susceptible of other technically equivalent elements.

The present invention is adapted to be employed both on new knitting machines and on pre-existing knitting machines, in the latter case substituting, for example, some parts of the dial assembly.

The invention attains important advantages, both in structural and functional terms. First of all, the invention allows overcoming at least one of the drawbacks of the prior art.

In addition, the invention allows obtaining a circular knitting machine in which it is possible to manage the angular position of the needle-holding plate, selectively and independently with respect to the further devices present in the dial assembly. This allows a greater flexibility of use of the plate needles, without the constraints that are typical of the known solutions. The invention also makes possible moving the plate of the needles, regardless of the operations carried out, simultaneously, by the further devices of the dial assembly.

The present invention also allows making a circular knitting machine which allows adjusting and optimizing with precision the quality of the knitwear formed. For example, it is possible to precisely align the rows of knitwear produced by the plate needles with respect to the rows of knitwear produced by the cylinder needles, bringing the plate into the phasing position, with the plate needles phased in an equidistant manner with respect to the two adjacent cylinder needles. Nevertheless, with the solution of the present invention, it is also possible, still with the object of improving the quality of the knitwear, to expressly introduce a slight offset/misalignment between plate needles and cylinder needles (obtainable by means of the offset device), so as to compensate for several variables tied to the actual operating conditions of the knitting machine, for example the type of thread used, the width of the knitwear being produced, etc.

The invention also allows precisely managing, in the different operating conditions and based on the textile requirements, the absorption of the thread during the formation of the knitwear on the cylinder of the needles and on the plate of the needles.

In addition, it is possible to precisely select (among a plurality of operating positions, also in a continuous manner) the angular position of the plate with respect to the cylinder, in a manner such that the mutual position between plate needles and adjacent cylinder needles is in phase or offset by a specific angular value, based on the characteristics desired for the knitwear being formed.

The position of the needle-holding plate can be selected in order to bring into phase or to introduce a desired and controlled offset.

The solution of the present invention, due to the offset device, allows recovering and maintaining constant the phasing between the plate needles and the cylinder needles even if there are elements which introduce undesired offsets, for example modifications in the position of the cams on the cylinder and on the plate.

Different from the known solutions, the present invention allows obtaining a circular knitting machine in which it is possible to introduce and manage an incremental offset of the needle-holding plate with respect to the needle-holding cylinder, simultaneously always ensuring a full and correct engagement between the various transmission elements which constitute the motion transmission chain as far as the needle-holding plate.

The present invention also allows making a circular knitting machine in which the offset of the needle-holding plate with respect to the needle-holding cylinder can occur in a continuous manner, among a plurality of operating positions, and in each intermediate position.

The present invention also allows modifying the offset of the needle-holding plate with respect to the needle-holding cylinder, even during the operation of the knitting machine, with plate and cylinder rotating (at constant speed and synchronously), without having to stop the machine.

Overall, the present invention allows reaching the objective of obtaining a programmable offset between plate and cylinder, in a continuous manner and maintaining both a correct engagement and the synchronism of the rotation.

The present invention also allows making a circular knitting machine characterized by a simple and rational structure, in particular of the dial assembly thereof, and characterized by a limited attainment cost with respect to the offered performances and quality.

The technical solution of the present invention also allows increasing the definition possibilities of the knitwear structures obtainable with a circular knitting machine, based on the different textile requirements.

The invention claimed is:

1. A circular knitting machine (1) for knitted or hosiery items, comprising:

a supporting structure;

at least one needle-holding cylinder (C) turnably mounted in said supporting structure and selectively rotatable around an axis of rotation (X) of the knitting machine;

a plurality of cylinder needles (N1) supported by said needle-holding cylinder (C) and movable in respective sliding seats (2) of the cylinder so as to produce a knitted fabric;

a dial assembly (3) arranged above said needle-holding cylinder (C) and comprising:

a supporting ring integral with said supporting structure and coaxial with said needle-holding cylinder;

a needle-holding plate (P) turnably mounted on said supporting ring so as to be able to rotate around a respective axis of rotation corresponding to said axis of rotation (X) of the knitting machine;

a plurality of plate needles (N2) supported by said needle-holding plate (P) and movable in respective sliding seats (5) of the plate so as to produce a knitted fabric;

motion generation elements configured for putting said needle-holding cylinder (C) in rotation around the axis of rotation (X);

motion transmission elements (10), operatively located between said motion generation elements and said dial assembly (3) and configured for creating a motion transmission chain that is able to transmit to the needle-holding plate (P) the rotation generated by the motion generation elements, so that the needle-holding cylinder (C) and the needle-holding plate (P) synchronously rotate, so that a specific angular rotation of the needle-holding cylinder (C) corresponds to an identical angular rotation of the needle-holding plate (P);

the motion transmission elements (10) comprising:

at least one first toothed wheel (11), receiving the rotary motion from the motion generation elements;

at least one second toothed wheel (12), placed downstream of said first toothed wheel (11) along the motion transmission chain, and mounted coaxially with the needle-holding plate (P) so that a rotation of the second toothed wheel (12) corresponds to an identical rotation of the needle-holding plate (P);

at least one offset device (20), located between said first toothed wheel (11) and said second toothed wheel (12), and comprising:

an inlet gear (21), engaged with said first toothed wheel (11) so as to be put in rotation by the first toothed wheel;

an outlet gear (22), engaged with said second toothed wheel (12) so as to put the second toothed wheel in rotation;

wherein the inlet gear (21) and the outlet gear (22) are mounted coaxially with one another, so as to rotate around an axis of the offset device (Y);

an actuator (25), acting upon the inlet gear (21) and/or upon the outlet gear (22) so as to shift, selectively and in a controlled manner, the inlet gear and/or the outlet gear along the axis of the offset device (Y), so as to change the engagement of the inlet gear (21) with the first toothed wheel (11) and/or the engagement of the outlet gear (22) with the second toothed gear (12).

2. The circular knitting machine (1) according to claim 1, wherein the inlet gear (21) and the outlet gear (22) are integral with one another and said actuator (25) acts upon the inlet gear (21) and upon the outlet gear (22) so as to shift them integrally along the axis (Y) of the offset device, so as to change the engagement of the inlet gear (21) with the first toothed wheel (11) and/or the engagement of the outlet gear (22) with the second toothed gear (12).

3. The circular knitting machine (1) according to claim 1, wherein the inlet gear (21) and the first toothed wheel (11) exhibit a same first toothing (31), said first toothing (31) consisting of non-linear teeth, having a transverse extension with respect to directions parallel to the axis of the offset device (Y), or wherein said first toothing (31) consists of helical teeth, ands wherein the outlet gear (22) and the second toothed wheel (12) exhibit an identical second toothing (32), said second toothing (32) consisting of non-linear teeth, having a transverse extension with respect to directions parallel to the axis (Y) of the offset device, or wherein said second toothing (32) consists of helical teeth.

4. The circular knitting machine (1) according to claim 1, wherein the inlet gear (21) and the outlet gear (22) are mounted coaxially with one another, in the offset device (20), and opposed so as to exhibit toothings oriented in opposed directions, first toothing (31) and the second toothing (32) being specular one to the other with respect to a median plane (M) perpendicular to the axis of the offset device (Y) and located between the inlet gear (21) and the outlet gear (22), and wherein the inlet gear (21) and the outlet gear (22) globally form a double gear with opposed integral wheels.

5. The circular knitting machine (1) according to claim 1, wherein the actuator (25) of the offset device (20), when it controls the shift of the inlet gear (21) and/or of the outlet gear (22):

introduces a change of engagement of the outlet gear (22) with the second toothed wheel (12) and keeps the engagement of the inlet gear (21) with the first toothed wheel (11), the change of engagement causing an angular forward or backward movement of the second toothed wheel (12), when engaged with the outlet gear, with respect to the direction of rotation, keeping a continuous transmission of the rotation and the synchronism of the rotary motion generated by the motion generation elements as far as the needle-holding plate (P) coaxial with the second toothed wheel; and/or introduces a change of engagement of the inlet gear (21) with the first toothed wheel (11) and keeps the engagement of the outlet gear (22) with the second toothed wheel (12), the change of engagement causing an angular forward or backward movement of the second toothed wheel (12), with respect to the direction of rotation, keeping a continuous transmission of the rotation and the synchronism of the rotary motion generated by the motion generation elements as far as the needle-holding plate (P) coaxial with the second toothed wheel.

6. The circular knitting machine (1) according to claim 1, wherein the offset device (20) is configured for axially moving, along said axis of the offset device (Y), the inlet gear (21) and the outlet gear (22) at least between:

a first operating position, in which the outlet gear (22) and the second toothed wheel (12) exhibit between them a first engagement which positions the needle-holding plate (P) with respect to the needle-holding cylinder (C), both rotating synchronously, in a first operating configuration, in which each needle (N2) of the plate (P) is located between two underlying, adjacent needles (N1) of the cylinder (C) at specific angular distances from them;

a second operating position, axially shifted with respect to the first operating position, in which the outlet gear (22) and the second toothed wheel (12) exhibit between them a second engagement which positions the needle-holding plate (P) with respect to the needle-holding cylinder (C), both rotating synchronously, in a second operating configuration, in which each needle (N2) of the plate (P) is located between two underlying, adjacent needles (N1) of the cylinder (C) in an angularly offset position with respect to the position taken in said first operating configuration.

7. The circular knitting machine (1) according to claim 1, wherein the offset device (20) operatively acts upon the inlet gear (21) and upon the outlet gear (22) so as to axially move them at least between:

a phasing position, in which the engagement between the outlet device (22) and the second toothed wheel (12) positions the needle-holding plate (P), rotating with the needle-holding cylinder (C), with the plate needles (N2) centered on two adjacent needles (N1) of the cylinder, with each plate needle basically in the middle between two respective adjacent needles of the cylinder, and angularly equidistant therefrom; and/or a delayed position, in which the engagement between the outlet gear (22) and the second toothed wheel (12) positions the needle-holding plate (P), rotating with the needle-holding cylinder (C), angularly moved backward with respect to said phasing position, with respect to the direction of rotation of the cylinder and of the plate, each plate needle (N2) being near the cylinder needle (N1)—of the two respective adjacent needles (N2) of the cylinder (C) between which it is located—following the same along the direction of rotation of the cylinder; and an advanced position, in which the engagement between the outlet gear (22) and the second toothed wheel (12) positions the needle-holding plate (P), rotating with the needle-holding cylinder (C), angularly moved forward with respect to said phasing position, with respect to the direction of rotation of the cylinder and of the plate, each plate needle (N2) being near the cylinder needle (N1)—of the two respective adjacent needles (N1) of the cylinder (C) between which it is located—preceding the same along the direction of rotation of the cylinder.

8. The circular knitting machine (1) according to claim 1, wherein the inlet gear (21) and the outlet gear (22) are axially moved by said actuator (25) so as to cover an axial travel, each axial position of said axial travel corresponding to a different operating position.

9. The circular knitting machine (1) according to claim 1, wherein the offset device (20) operatively acts upon the inlet gear (21) and upon the outlet gear (22), preferably integral with one another, so as to move them selectively and in a continuous manner among a plurality of operating positions, each characterized by a specific axial positioning of the gears along the axis (Y) of the offset device, and wherein the change of engagement occurs in a continuous manner between successive positions.

10. The circular knitting machine (1) according to claim 1, wherein the angular offset width of the needles (N2) of the plate (P) with respect to the needles (N1) of the cylinder (C), which can be obtained with said axial travel which the inlet and outlet gears can move as a result of the translational motion transmitted to them by said actuator (25), is at least 0.01°, or at least 0.1°, or at least 0.5°, or at least 1°, or at least 2°, or at least 4°, and/or wherein said actuator (25) is preferably an electric motor.

11. The circular knitting machine (1) according to claim 1, wherein the teeth of the outlet gear (22) form a plurality of cams distributed all around the gear itself and engaging with the teeth of the second toothed wheel (12), so that an axial shift of the outlet gear (22) causes a pushing action by said plurality of cams upon the teeth of the second toothed wheel (12), said push causing an angular forward movement or an angular backward movement of the second toothed wheel, keeping a correct engagement of the outlet gear with the second toothed wheel, and wherein an axial shift of the outlet gear (22) in a first direction, along the axis of the offset device (Y), corresponds with an angular forward movement, according to the direction of rotation, of the second toothed wheel (12), and an axial shift of the outlet gear (22) in a second direction, opposed to said first direction along the axis of the offset device (Y), corresponds with an angular backward movement, according to the direction of rotation, of the second toothed wheel (12).

12. The circular knitting machine (1) according to claim 1, wherein the teeth of the outlet gear (22) form multiple cams engaging one after the other with the teeth of the second toothed wheel (12), which allow keeping a correct engagement even as a result of an axial shift of the outlet gear with respect to the second toothed wheel.

13. The circular knitting machine (1) according to claim 1, wherein said first toothing (31) and said second toothing (32) are geometrically equivalent to one another.

14. The circular knitting machine (1) according to claim 7, wherein said delayed position and said advanced position, taken by the inlet gear (21) and by the outlet gear (22) along said axial travel, are on opposed sides with respect to the phasing position.

15. The circular knitting machine (1) according to claim 7, wherein the delayed position and the advanced position are positions in which the change of engagement between outlet gear (22) and second toothed wheel (12) causes an offset of the position of the needles (N2) of the plate (P) with respect to the needles (N1) of the cylinder (C).

16. The circular knitting machine (1) according to claim 7, wherein the phasing position corresponds to said first operating position and the delayed position or the advanced position corresponds to said second operating position, or wherein the advanced position corresponds to said first operating position and the delayed position corresponds to said second operating position, the phasing position being a third operating position between said first and said second operating position.

17. The circular knitting machine (1) according to claim 9, wherein the inlet (21) and outlet (22) gears can be axially moved in a continuous manner among the plurality of operating positions so as to introduce an incremental offset on the angular positions of the needles (N2) of the plate (P) with respect to the needles (N1) of the cylinder (C), plate and cylinder rotating synchronously.

18. The circular knitting machine (1) according to claim 1, wherein the sliding seats (2) of the cylinder (C), housing the cylinder needles (N1), are longitudinal grooves in the needle-holding cylinder (C), parallel to the axis of rotation (X), and the sliding seats (5) of the plate (P), housing the plate needles (N2), are radial grooves in the needle-holding plate (P), centered on said axis of rotation (X), and wherein the needles (N1) of the cylinder (C) are movable parallel to the axis of rotation and the needles (N2) of the plate (P) are movable radially with respect to the axis of rotation.

19. The circular knitting machine (1) according to claim 11, wherein the greater the axial shift of the outlet gear, the greater the angular offset of the second toothed wheel, or wherein the angular offset of the second toothed wheel changes proportionally, preferably in a linear manner, as a function of the value of axial shift of the outlet gear.

20. The circular knitting machine (1) according to claim 1, wherein the offset device (20) is physically located between the first toothed wheel (11) and the second toothed wheel (12), and engaged with both along said motion transmission chain, so as to transmit a continuous rotary motion from the first toothed wheel (11) to the second toothed wheel (12), with a possibility of angular offset of the second toothed wheel mounted coaxially on the needle-holding plate.

* * * * *